US011187508B2

(12) United States Patent
Thuman et al.

(10) Patent No.: US 11,187,508 B2
(45) Date of Patent: Nov. 30, 2021

(54) WARHEAD

(71) Applicant: BAE SYSTEMS BOFORS AB, Karlskoga (SE)

(72) Inventors: Christer Thuman, Karlskoga (SE); Björn Johansson, Karlskoga (SE); Peter Tjernström, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 16/762,538

(22) PCT Filed: Oct. 30, 2018

(86) PCT No.: PCT/SE2018/051107
§ 371 (c)(1),
(2) Date: May 8, 2020

(87) PCT Pub. No.: WO2019/112502
PCT Pub. Date: Jun. 13, 2019

(65) Prior Publication Data

US 2020/0340788 A1 Oct. 29, 2020

(30) Foreign Application Priority Data

Dec. 5, 2017 (SE) ..... 1700300-5

(51) Int. Cl.
*F42B 12/32* (2006.01)
*F42B 12/24* (2006.01)

(52) U.S. Cl.
CPC ..... *F42B 12/32* (2013.01); *F42B 12/24* (2013.01)

(58) Field of Classification Search
CPC ..... F42B 12/24; F42B 12/32
USPC ..... 102/492, 494, 496, 497
See application file for complete search history.

(56) References Cited

U.S. PATENT DOCUMENTS 1,154,437 A * 9/1915 Rimailho ..... F42B 12/32 102/496
1,230,217 A * 6/1917 Quist ..... F42C 15/24 102/249
2,564,751 A * 8/1951 Cook ..... F42B 27/00 102/482
3,815,504 A 6/1974 Tieben
3,974,771 A 8/1976 Thomanek
(Continued)

FOREIGN PATENT DOCUMENTS

DE 2557678 A1 6/1977
DE 3235404 A1 4/1983
(Continued)

OTHER PUBLICATIONS

International Search Report (dated Dec. 14, 2018) for corresponding International App. PCT/SE2018/051107.

*Primary Examiner* — Bret Hayes
(74) *Attorney, Agent, or Firm* — WRB-IP LLP

(57) ABSTRACT

A warhead includes an outer casing and an inner shell, which delimits a central space for an explosive substance. The inner shell receives a series of preformed elements, which are arranged in contact with the outer side of the inner shell. The inner shell is arranged for a controlled fragmentation upon a detonation of the explosive substance. The preformed elements are arranged with a surface contact against the inner shell.

6 Claims, 4 Drawing Sheets

(56) References Cited

U.S. PATENT DOCUMENTS

| | | | | | |
|---|---|---|---|---|---|
| 4,063,508 | A * | 12/1977 | Whiting | C06B 45/10 | 102/393 |
| 4,129,061 | A * | 12/1978 | Bedall | F42B 12/32 | 86/20.12 |
| 4,936,217 | A * | 6/1990 | Hofmann | F42B 12/32 | 102/496 |
| 4,982,668 | A * | 1/1991 | Bender | F42B 12/32 | 102/495 |
| 5,535,679 | A * | 7/1996 | Craddock | F42B 12/32 | 102/389 |
| 8,381,657 | B1 | 2/2013 | Hooke | | |
| 10,018,453 | B1 * | 7/2018 | McCoy | F42B 33/00 | |
| 10,502,538 | B1 * | 12/2019 | Thuman | F42B 12/32 | |
| 2009/0211484 | A1 * | 8/2009 | Truitt | F42B 12/50 | 102/497 |
| 2014/0020590 | A1 * | 1/2014 | Torsten | F42B 33/00 | 102/495 |

FOREIGN PATENT DOCUMENTS

| | | | |
|---|---|---|---|
| DE | 29723399 | U1 | 10/1998 |
| EP | 0189585 | A1 | 1/1986 |
| EP | 0616189 | A2 | 9/1994 |
| WO | 2016171794 | A1 | 10/2016 |
| WO | 2017120684 | A1 | 7/2017 |

* cited by examiner

WARHEAD

BACKGROUND AND SUMMARY

The present invention relates to a warhead comprising an outer casing and an inner shell, which delimits a central space for an explosive substance, in which the inner shell receives a series of preformed elements, which are arranged in contact with the outer side of the inner shell, and the inner shell is arranged for a controlled fragmentation upon a detonation of the explosive substance.

Fragmenting warheads have long been known. Such warheads are often used in shells and other projectiles, but also in certain types of defence charges. The ways of triggering a detonation of the warheads vary and many different ways are known by the person skilled in the art, such as time fuses, percussion fuses, striking pins and electrical impulse currents.

Two main types of fragmentation are often mentioned, on the one hand splitting of the warhead itself, generally its casing, and on the other hand ejection of fragments which are configured and arranged in the warhead already during manufacture, so-called preformed fragments. Fragmentation of the casing can in turn be realized in two different ways, firstly by a random splitting of the casing upon detonation, and secondly by the casing having been provided with weakenings where a splitting is desired. The latter way is often referred to as controlled fragmentation.

One of many examples of preformed fragments is shown in U.S. Pat. No. 3,974,771A, in which ball-shaped fragments are arranged in spaces between an explosive charge and an outer casing. The fragments can be mutually identical or have different size and/or weight.

Examples of a fragmented casing are shown, inter alia, in U.S. Pat. No. 5,040,464A, in which a set of internally arranged grooves control the shape and mass of the fragments which are generated in a detonation.

Since the size, shape and mass of the fragments which are expelled upon a detonation of a warhead has a bearing on the effect which is achieved on the target, it is in certain cases interesting to combine preformed fragments with a controlled fragmentation in one and the same warhead. Such warheads are sometimes said to have a bimodal effect. Examples of such warheads are shown in WO2016/171794A1, which shows balls or other types of fragments which are arranged in grooves in a mortar shell.

Another way of achieving a bimodal effect is shown in WO2017/120684A1, in which two matrices of preformed elements, which are spherical and non-spherical respectively, are arranged in one and the same warhead. The two matrices are said in certain embodiments to come together into a single matrix.

The different existing warheads have different types of effect patterns and are usable for different types of targets or combinations of targets. Their effectiveness has been studied and, for targets or combinations of targets having different types of protection and weaknesses, different types of warheads having different effect patterns are suitable.

It is therefore wished to provide a warhead having an effect pattern which has maximum effect against a combination of semi-hard and soft targets. At the same time, the warhead must have sufficient strength to cope with stresses during transport and a possible firing.

It is desirable to provide a warhead indicated in the introduction given the characteristic that the preformed elements are arranged with a surface contact against the inner shell.

BRIEF DESCRIPTION OF THE DRAWING

The invention will now be described with reference to the appended drawings, in which.

DETAILED DESCRIPTION

Figure 1:
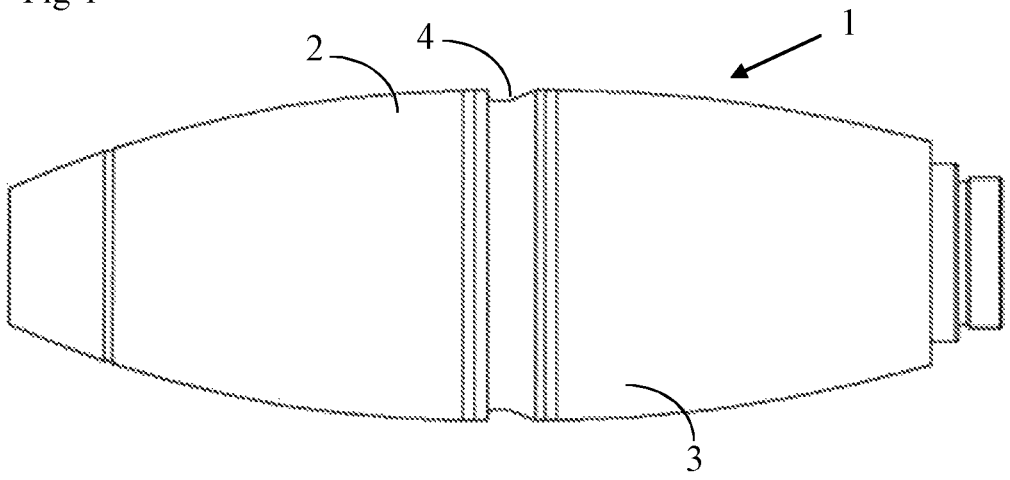
FIG. 1 shows a direct side view of a warhead according to the invention.

In FIG. 1 is shown are exemplifying warhead 1, which is configured in accordance with the present invention. The outer side of the warhead 1 has a conventional design having a front and a rear body 2, 3 and an intervening middle section 4 at which the warhead 1 is dividable. The conventional outer side of the warhead 1 helps to make it suitable for use as a projectile in existing weapon systems without the need to make new procurements or adaptations of existing equipment.

The warhead 1 can be provided with further elements, such as a nose and/or tail in accordance with expert considerations. These elements can long be known, but can also be of newly developed types. The exact configuration of these elements lies outer side the scope of the present invention and is in principle independent of the present invention.

Figure 2:
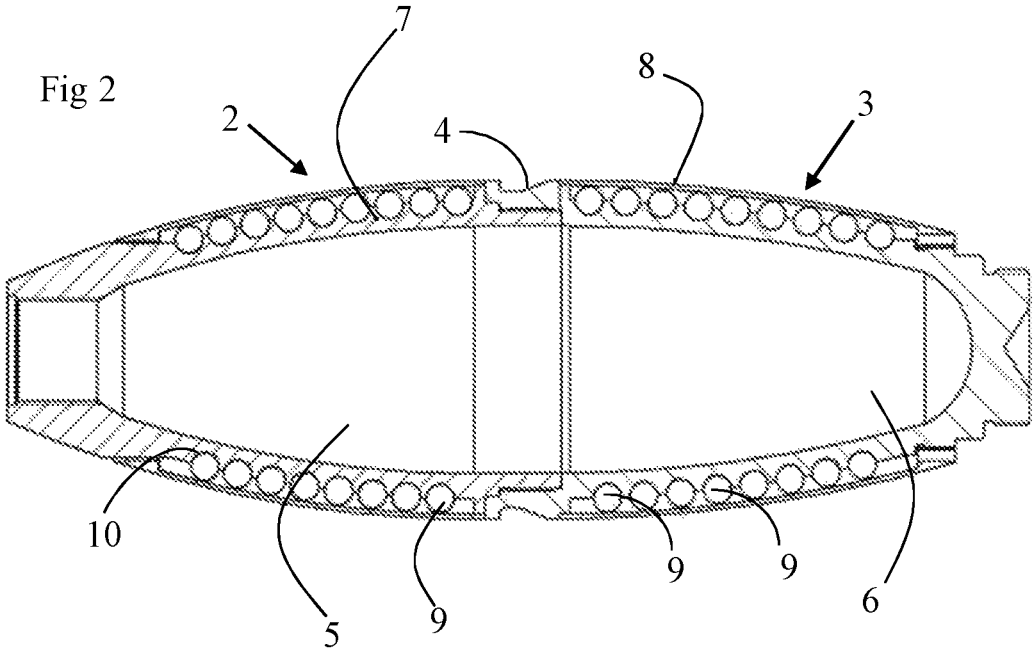
FIG. 2 shows an axial sectional view of the warhead according to FIG. 1.

I FIG. 2, a section through the warhead 1 according to FIG. 1 is shown. In the cross section can be seen a front 5 and a rear 6 chamber, for an explosive substance. The chambers 5, 6 are surrounded and outwardly delimited by an inner casing 7, which in turn is surrounded by an outer shell 8, which in the shown embodiment is also divided. On the outer side of the inner casing 7 are arranged a number of preformed fragments 9. In the shown embodiment, the preformed fragments 9 are spherical, but the invention is not limited to the case in which the fragments 9 have precisely this shape.

The preformed fragments 9 are recessed somewhat in the inner casing 7, preferably approximately corresponding to half its cross-sectional dimension. The recesses 10 have in the shown embodiment a cupped shape. The recess 10 is such that the inner casing 7 is in contact with the fragments 9 over, broadly speaking, the whole of the recessed surface of the fragments 9, which in the shown embodiment means approximately half of the total surface area of the preformed fragments 9. The, relatively speaking, large contact surface between the fragments 9 and the inner casing 7 results in the inner casing 7 acting as an effective sabot in order to give the preformed fragments 9 a high acceleration when the warhead 1 detonates.

At the same time, the relatively large contact surface also provides a limitation in the pressure to which the preformed fragments 9 are exposed when they are accelerated by the detonation, and reduces the risk of the preformed fragments 9 being crushed or pulverized. Instead, they will only be slightly deformed and a high acceleration is given, resulting in a high penetrating capability in the target, for example a good penetration through armoured plate.

The preformed fragments 9 are arranged one by one in the sabot 7, without mutual contact with one another. The result of this is that they are not exposed to stresses from one another, neither during the firing phase nor upon the detonation. Since the preformed fragments 9 are advantageously made of high-density heavy metal, for maximum penetrating capability, they would potentially be able to adversely affect one another in the event of mutual contact. An adverse effect of this kind could otherwise arise, for example, when the preformed fragments are exposed to forces from a large number of fragments in front of them.

Figure 3A:
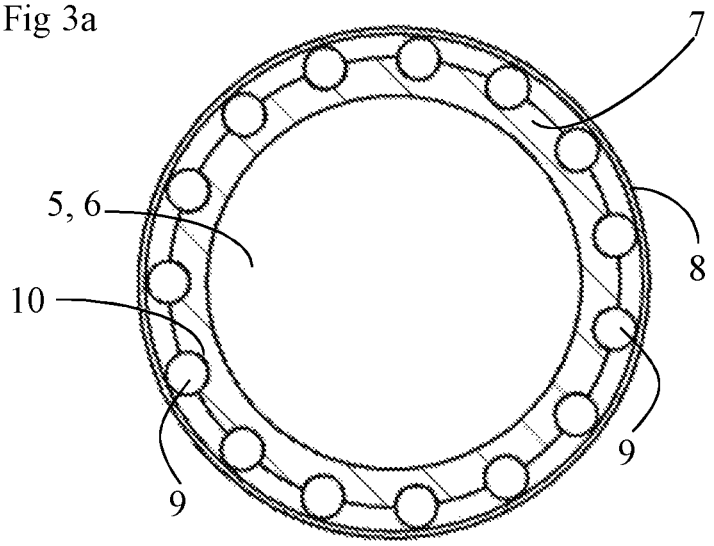
FIGS. 3*a* and 3*b* show radial sections through the warhead at two different points in its longitudinal direction.
Figure 3B:
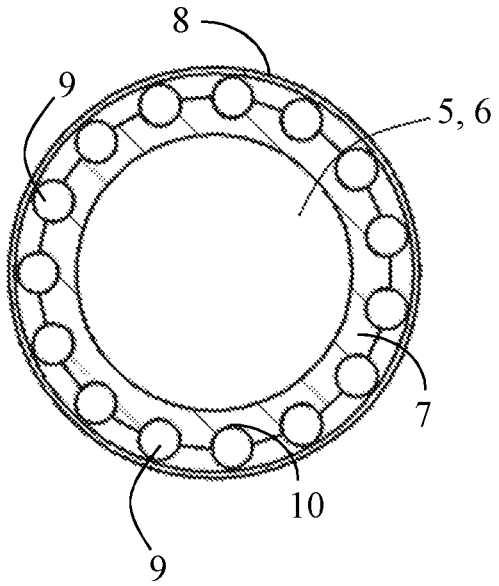

In FIGS. 3*a* and 3*b*, two sections through the warhead 1 are shown. The cross sections are taken at different places in the longitudinal direction of the warhead 1 at two different diametral dimensions. In the cross sections can be seen how the preformed fragments 9 are arranged at a distance apart in the cupped recesses 10 in the sabot 7 also in the circumferential direction. In the shown embodiment, the preformed fragments 9 are arranged with the same number of fragments 9 per layer, which means that the fragments 9 are arranged somewhat more sparsely in FIG. 3*a*, in which the diameter of the warhead 1 is greater than in FIG. 3*b*.

Figure 4A:
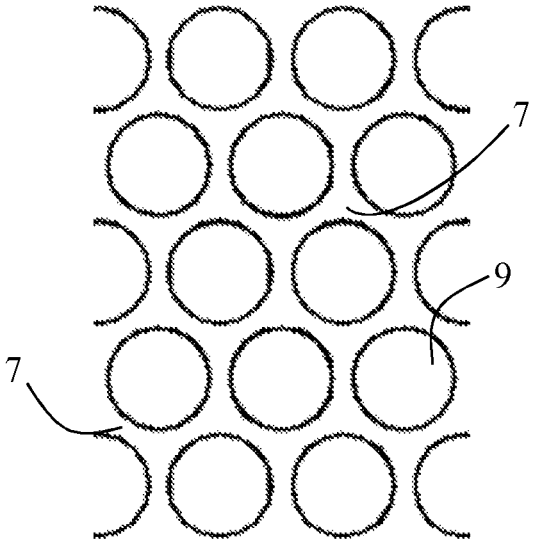
FIGS. 4*a* and 4*b* show a detailed view, directly from the side, of a portion of an inner casing in the warhead.

In FIG. 4*a* is shown a smaller portion of some rows of the preformed fragments 9, which are recessed in the sabot 7. In this figure, it can be seen especially well that the preformed fragments 9 are arranged at a distance apart, so that they are not exposed to stresses from one another, for example when the warhead 1 is fired. The distances between the preformed fragments 9 also provide good opportunities to adjust the weight of the warhead 1 with high precision. In particular, opportunities are given to limit the total weight of the warhead 1, since the preformed fragments 9 do not need to be stacked one upon another in order to fill a certain volume, but rather are placed in recesses in precisely that number and formation which is required to attain the intended effect in the target.

The interspaces between the preformed fragments 9 are constituted by the sabot 7 in those regions in which the cupped recesses 10 are not arranged. The material in these regions together forms a framework structure, which gives a good strength to the warhead 1 as a whole before and during the firing. The warhead 1 must withstand the loads which arise during both transport and storage and upon a possible firing.

When the warhead 1 detonates, the sabot 7 will by contrast be split into smaller parts which are accelerated at the same time as the preformed fragments 9 are accelerated, and the outer shell 8 is splintered. The detonation forces herein act from inside on the sabot 7, the preformed fragments 9 and the outer shell 8. It is an object of the invention that the shape and size of the smaller parts of the sabot 7 are controllable, so that the desired effect on the target is obtained, primarily as regards soft targets. The sabot 7 will be broken up in the cupped recesses 10, since the material in the sabot 7 is at its thinnest there. Fracture will also occur in the direction transversely to those portions of the sabot 7 which have full thickness. Through the arrangement of the cupped recesses 10 in a systematic pattern over the whole of the surface of the inner casing or of the sabot 7, a deliberate, controlled fragmentation of the sabot 7 is achieved.

Figure 4B:
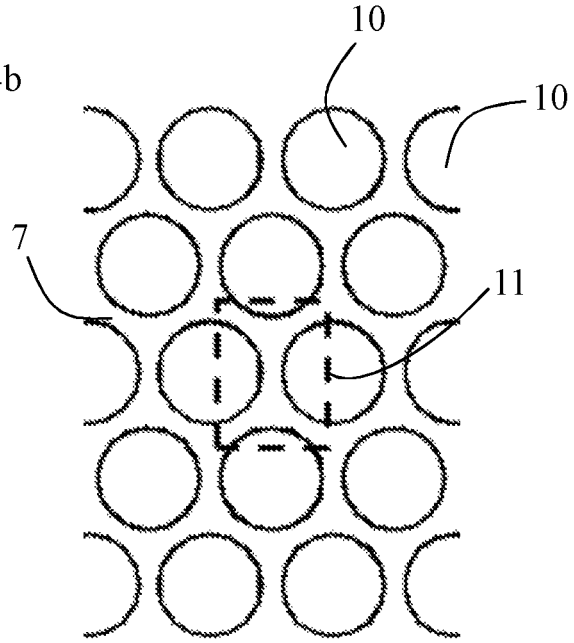

In FIG. 4*b*, the approximate appearance of a fragment 11 which is the result of the controlled fragmentation is sketched. Further fragments 11 with broadly corresponding appearance and mass will be obtained, since the cupped recesses 10, and the material weakenings which they bring about, are arranged in a pattern which is repeated over the whole of the inner casing or the sabot 7. At the same time, the cupped recesses 10 have a parallel function in that they help to hold the preformed fragments 9 in place prior to the detonation and to accelerate them gently in connection with the detonation.

The fragments 11 which are the result of the controlled fragmentation therefore have a size and mass which is effective against semi-hard targets. The preformed fragments 9 act primarily against hard targets, such as armoured plate, whilst the splinter from the outer shell 8 acts primarily against soft targets. In certain embodiments, the outer shell 8 is also configured with a controlled fragmentation, which in certain cases resembles the controlled fragmentation of the inner casing 7, but in other cases is configured according to the prior art in the field.

The cupped recesses 10 in the inner casing or sabot 7, which is often made of steel, are achieved with any suitable production technology, such as machine cutting, powder metallurgy technology, casting or additive technology, etc. The thickness of the sabot 7 at the bottom of the cupped recesses 10 is in an advantageous embodiment 0.4-0.5 times the characteristic length of the preformed fragments 9, since the sabot 7 is made of steel and the preformed fragments 9 are made of heavy metal. In other materials and combinations of materials, other mutual size relationships can apply. Should the preformed fragments 9 be spherical, the characteristic length is the diameter thereof.

In a practical illustrative embodiment, the diameter of the spherical heavy metal fragments 9 is 10 mm, and the thickness of the steel sabot 7 at the thinnest point is about 5 mm. The recesses 10 have a depth which corresponds to approximately half the characteristic length, which results in the thickness of the sabot 7 at the thickest point being in this case about 10 mm.

Figure 5:
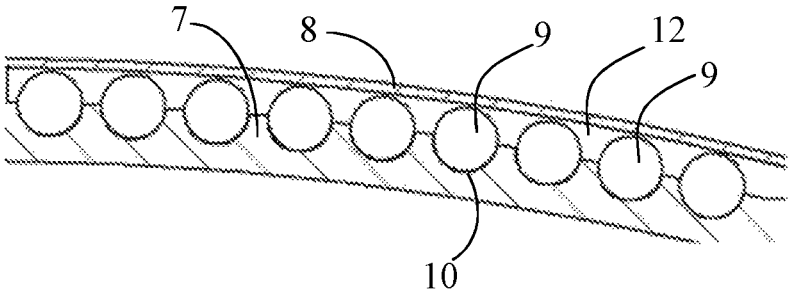
FIG. 5 shows a detailed view of a cross section through a part of the outer wall of the warhead.

In FIG. 5, a portion of the sabot 7, the preformed fragments 9 and the outer shell 8 are shown in detail in a cross section. The space 12 between the sabot 7 and the preformed fragments 9 on the one hand, and the outer shell 8 on the other hand, are filled with a filler material 12, which holds the preformed fragments 9 in place. The filler material 12 also seals against gases from the detonation, for an effective acceleration of the preformed fragments 9 and the fragments 11 from the controlled fragmentation.

The filler material 12 has low density, such as plastic, epoxy, pressed magnesium powder or pressed aluminium powder, etc. The total mass for the warhead 1 can thus be kept down to reasonable levels, despite the fact that the preformed fragments 9 are often made of heavy metal. A limitation of the mass facilitates the general handling of the warhead 1, but also has the advantage that the warhead 1 acts together with existing weapon systems without these needing to be adapted to any major extent.

In the above description and the drawing, the warhead 1 has been shown as a dividable projectile. The dividability is not a precondition for the invention being able to function according to the above description, but rather it can very well be made non-dividable according to the principles for producing warheads which are known to the person skilled in the art in the field. Nor is the invention limited to just projectiles, but is usable in any permitted form of warhead.

As has also been mentioned in the description above, the invention is not limited to preformed fragments 9 which are spherical, but rather any other shape which the person skilled in the an, through routine tests, finds gives the aspired result, is conceivable as an alternative.

Also the shape of the fragments 11 which is the result of the controlled fragmentation is variable by varying the size of and distance between the cupped recesses 10. The mutual position thereof also affects the size and shape of the fragments 11. As an alternative to the rings of recesses 10 which are shown in the drawings, the recesses 10, for example, can be arranged in rows which are substantially parallel with the longitudinal axis of the warhead, in spiral pattern, etc. In a further alternative embodiment, the recesses 10 are arranged in different configurations on different parts of the inner casing 7 in order to achieve different kinds of directivity. A further alternative is that the recesses 10 are arranged so that the strength of the warhead 1 is affected, preferably in the positive direction. One way of achieving this is to arrange the recesses 7 at greater distance apart where the stresses can be assumed to be greatest, for example at the base of a shell which is to be fired from a barrel.

The invention is further variable within the scope of the appended patent claims.

The invention claimed is:

1. A warhead comprising an outer casing and an inner shell, which delimits a central space for an explosive substance, in which the inner shell receives a series of preformed elements, which are arranged in contact with an outer side of the inner shell, and the inner shell is arranged for a controlled fragmentation upon a detonation of an explosive substance, wherein the preformed elements are arranged with a surface contact against the inner shell, the inner shell comprising recesses arranged to distribute force from the detonation amongst the preformed elements, the preformed elements being in contact with respective ones of the recesses over half of a total surface area of the preformed elements.

2. The warhead according to claim 1, wherein the recesses in the inner shell are arranged to act as weak links upon the detonation, for controlled fragmentation of the inner shell.

3. The warhead according to claim 1, wherein a thickness of the inner shell is of a same order of magnitude as the preformed elements.

4. The warhead according to claim 1, wherein a space between the inner-shell and the outer casing houses a filler material.

5. The warhead according to claim 4, wherein a density of the filler material is lower than a density of the inner shell and of a density of the preformed elements respectively.

6. The warhead according to claim 4, wherein the filler material bears against the preformed elements.

* * * * *